US006578337B2

(12) United States Patent
Scholl et al.

(10) Patent No.: US 6,578,337 B2
(45) Date of Patent: Jun. 17, 2003

(54) DEVICE FOR TIGHTENING STRAPPING BANDS

(75) Inventors: Detlef Scholl, Piesport (DE); Leo Zeimetz, Büttelborn (DE); Peter Nober, Rommersheim (DE)

(73) Assignee: Cyklop GmbH, Cologne (DE)

( * ) Notice: Subject to any disclaimer, the term of this patent is extended or adjusted under 35 U.S.C. 154(b) by 0 days.

(21) Appl. No.: 10/169,530

(22) PCT Filed: Apr. 21, 2001

(86) PCT No.: PCT/EP01/04533

§ 371 (c)(1),
(2), (4) Date: Jun. 27, 2002

(87) PCT Pub. No.: WO01/92113

PCT Pub. Date: Dec. 6, 2001

(65) Prior Publication Data

US 2003/0056337 A1 Mar. 27, 2003

(30) Foreign Application Priority Data

May 26, 2001 (DE) ..... 100 26 200

(51) Int. Cl.[7] ..... A44B 21/00; B65B 13/22; B65B 67/08

(52) U.S. Cl. ..... 52/592; 53/582; 100/33 PB; 156/494; 156/502; 24/69 TM; 24/68 R; 24/69 TS; 24/70 ST

(58) Field of Search ..... 24/69 TM, 69 TS, 24/69 R, 69 ST, 68 R, 68 B, 68 D, 70 ST; 156/73.5, 391, 494, 502; 100/33 PB; 53/585, 592

(56) References Cited

U.S. PATENT DOCUMENTS

| | | | | |
|---|---|---|---|---|
| 4,305,774 A | * | 12/1981 | Wedeking et al. | 156/494 |
| 5,653,095 A | * | 8/1997 | Stamm | 53/592 |
| 5,858,164 A | * | 1/1999 | Panjwani et al. | 156/359 |
| 5,954,899 A | * | 9/1999 | Figiel et al. | 156/73.5 |
| 6,516,715 B1 | * | 2/2003 | Reiche | 100/33 PB |

FOREIGN PATENT DOCUMENTS

EP 0 664 256 A1 11/1994

OTHER PUBLICATIONS

International Search Report, dated Oct. 2, 2001.
Cyklop International Instructions Brochure regarding "Hand Tool CE 92".
Cyklop International Parts List Brochure regarding "Hand Tool CE 92".
Cyklop International Parts List Brochure regarding "Compressed Air Tool PN 6.1 and PVO 19/25/32 B".

* cited by examiner

*Primary Examiner*—Victor Sakran
(74) *Attorney, Agent, or Firm*—Fay, Sharpe, Fagan, Minnich & McKee

(57) ABSTRACT

The invention relates to a tensioning device for tightening strapping bands. When a tensioning motor runs forwards in the tensioning direction, a tensioning wheel is automatically pivoted against an abutment in the opposite direction. Once the tensioning process is complete, said tensioning wheel is pivoted back out of the tensioning position and into the starting position by running the tensioning motor backwards.

20 Claims, 4 Drawing Sheets

DEVICE FOR TIGHTENING STRAPPING BANDS

DEVICE FOR TIGHTENING STRAPPING BANDS

The invention relates to a device for tightening strapping bands, in particular of plastics, with an abutment and a tensioning wheel provided with a return stop which can be driven by a tensioning motor by means of a gearing, which tensioning wheel forms a tensioning channel with the abutment for the band ends to be tightened and which is arranged in a gearing block with the tensioning motor and the gearing, which is mounted as a whole in a pivoted manner around a first stationary axis in the base frame of the device and which is held by holding means which are mounted with friction on a tensioning wheel pin in its ineffective position lifted from the band end and is pivoted against the abutment under the action of a (second) pressure element when the tensioning wheel starts in the tensioning direction and the holding means loses its effective position.

BACKGROUND OF THE INVENTION

A device of this type is known (EP 0664256 B1), wherein the lower band end is clamped between the base plate of the device and an intermediate wedge, while the upper band end has to be threaded between the tensioning wheel and the intermediate wedge before the tensioning wheel is pressed by means of the start-up of a spring onto the abutment and draws the upper band end over the intermediate wedge and tightens it therewith. After the tightening and possibly welding of the band ends it is necessary to ventilate the tensioning wheel with a special hand lever which is provided for this and to bring it into its ineffective position lifted from the band against the force of the strong tensioning spring, so that the device can be drawn laterally and backwards from the strapping band.

The insertion of the band ends and the ventilation of the tensioning wheel is difficult, demands force during the pressing of the hand lever and usually cannot be executed with one hand. As the band ends to be connected run through different openings of the band channel, they can only be inserted one after the other and it can easily happen that they are displaced laterally against one another in the device and that they are not exactly on top of one another during the subsequent welding and that a faulty welding results.

In a similar device (hand device CE 92 of Cyklop GmbH), not the tensioning wheel, but the abutment and the intermediate wedge are pivoted backwards with a special hand lever, so as to loosen the upper band end clamped between the profiled circumferential surface of the tensioning wheel and the intermediate wedge and to open the band channel.

A tensioning device is also known (hand device PN 6.1 of Cyklop GmbH) which serves for the tightening of strappings using steel bands, the band ends of which being closed by a closing seal after the strapping. Hereby, both band ends are drawn through the closing seal, the lower band end is placed around the closing seal and is hereby secured against being drawn out, while the upper band end is drawn over a tensioning wedge by a tensioning wheel, which wedge is pressed against the tensioning wheel by means of a spring. When the strapping shall be loosened once again before the closing of the seal, so as to correct the strapping or to tighten it further, the tensioning wheel can be reversed. Here it is also necessary, for taking the device from the tightened and closed strapping, to pivot the tensioning wedge backwards with a hand lever so as to open the band channel and to be able to draw out the device laterally from the strapping.

SUMMARY OF THE INVENTION

It is the object of the invention to form a device of the type explained in more detail above in such a manner that plastic bands having band ends immediately on top of one another can initially be inserted into an open band channel and tightened in the initial position, whereby the tensioning wheel and the abutment reach their tensioning position just by switching on the tensioning motor and tighten the strapping band and loosen themselves automatically from the strapping band after the tightening and possibly closing action, return to their initial position and open the band channel again.

This object is solved by means of the invention in that the tensioning wheel can be driven by the tensioning motor in the tensioning direction and in the opposite direction and that the return stop is a freewheel with a brake which blocks the reverse rotation of the tensioning wheel when the tensioning motor stops, but which allows a reverse rotation of the tensioning wheel when the tensioning wheel reverses, and that the tensioning wheel with its tensioning wheel swivel pin is mounted rotatably in an eccentric with friction, which itself is rotatably guided in a steering lever which is mounted in a pivoted manner around a second stationary axis at the base frame and that a freewheel which is blocked against the tensioning direction between the tensioning wheel pin and the eccentric is arranged as stop means.

This embodiment has the advantage that a special mechanism which has to be operated by hand is not necessary to loosen the tensioning wheel and the abutment from their engagement with the band ends, but that it is sufficient to switch the tensioning motor into forward gear so as to bring the tensioning wheel into its operating position and to initiate the tensioning process and to later switch the tensioning motor into reverse gear so as to lift the tensioning wheel from the abutment and to open the tensioning channel. The device can hereby be gripped and guided with only one hand, the strapping band can easily be inserted with the other hand and be drawn out again from the band channel, and for initiating the tightening process and for opening the band channel, only one push button has to be pressed at the device.

As has already been mentioned, the band ends in the tensioning channel can be immediately on top of one another, whereby the lower band end is held in a non-positive manner by the surface of the abutment while the upper band end is drawn along on the surface of the lower band end by the circumferential surface of the tensioning wheel which is provided with a profile and is thereby tightened around a package or the like. This has the advantage that both band ends on top of one another can be inserted into the open tensioning channel by one hand from one side, while the other hand holds the tensioning device and initiates the tensioning process by pressing a button.

So as to ensure a precise swivel in of the tensioning wheel and an effective tightening of the band, the first stationary axis of the gearing block and the second stationary axis of the steering lever can be arranged on different sides of the abutment, conveniently in such a manner that the first stationary axis of the gearing block is arranged in the tensioning direction in front of the abutment and the second stationary axis of the steering lever is arranged behind the abutment. By this it is achieved that the clamping angle between the abutment surface and the tangent of the tensioning wheel changes automatically during start-up of the tensioning wheel in such a manner that the clamping action exerted on the band increases with increasing band tension, but that the tensioning wheel can run without further ado in the opposite direction during the later lifting from the band ends connected to one another and loosens itself automatically from the band. The tensioning wheel is hereby guided by the eccentric and the guide lever in such a manner that it is pivoted against the abutment during a rotation of the tensioning wheel in the tensioning direction in the opposite direction and is lifted from the abutment during a rotation of the tensioning wheel in the opposite direction.

The bearing friction of the tensioning wheel pin in the eccentric should conveniently not be too large, so that the tensioning wheel can exert a sufficiently high tensioning force on the band end to be tightened. It is therefore convenient if the eccentric is under the influence of a first pressure element which strives to rotate the eccentric in the tensioning direction of the tensioning wheel. This pressure element can be a torsion spring or a spiral spring which supports the rotational movement of the eccentric or carries it out.

The second freewheel with brake is conveniently arranged in the drive shaft train of the gearing for the tensioning wheel and blocks the reverse rotation of the drive shaft train when the tensioning wheel has produced the desired band tightening and the tensioning motor stops. The brake nevertheless allows a reverse rotation of the drive shaft train when the tensioning motor reverses. By this, it is achieved that the strapping is kept under tension without loading the tensioning motor until the band ends have been connected to one another and cut, for example by means of a seal or by welding, before the tensioning wheel reverses and hereby pivots back into its initial position.

The brake at the second freewheel can be a brake disc connected to the freewheel hub, which disc runs between rigid friction elements pressed together by spring elements.

So as to pivot the tensioning wheel reliably down onto the band ends to be tightened during the start-up in the tensioning direction, a torsion spring is provided as the pressure element, which spring is wound around the pivot axis of the gearing block, which spring supports the pivoting movement of the tensioning wheel against the stationary abutment. In the vented position, lifted off from the abutment, the tensioning wheel is then held in the gearing against the action of the spring by the detent torque of the tensioning motor and/or by the freewheel stop in the gearing and by the freewheel stop in the eccentric.

It is particularly convenient if the eccentric is arranged on a band side guide element which is rotatable around the pivot pin of the tensioning wheel, which element is under the influence of the first pressure element which rotates the band side guide element in the tensioning direction so that it covers the band channel laterally when the tensioning wheel is in its tensioning position pivoted down on the abutment. This band side guide element is a sector disc which comprises a chamfer guided inwardly at its front edge in the tensioning direction. If the band ends project laterally from the band channel after having been inserted therein, they are gripped after the swivel in of the sector disc by the chamfer and are completely pressed into the band channel. During the tightening, the band ends can also not slide laterally from the band channel.

Further characteristics and advantages of the invention result from the following description and the drawings, in which a preferred embodiment of the invention is explained in detail with the help of an example. It shows:

DETAILED DESCRIPTION OF PREFERRED EMBODIMENT

Figure 1:
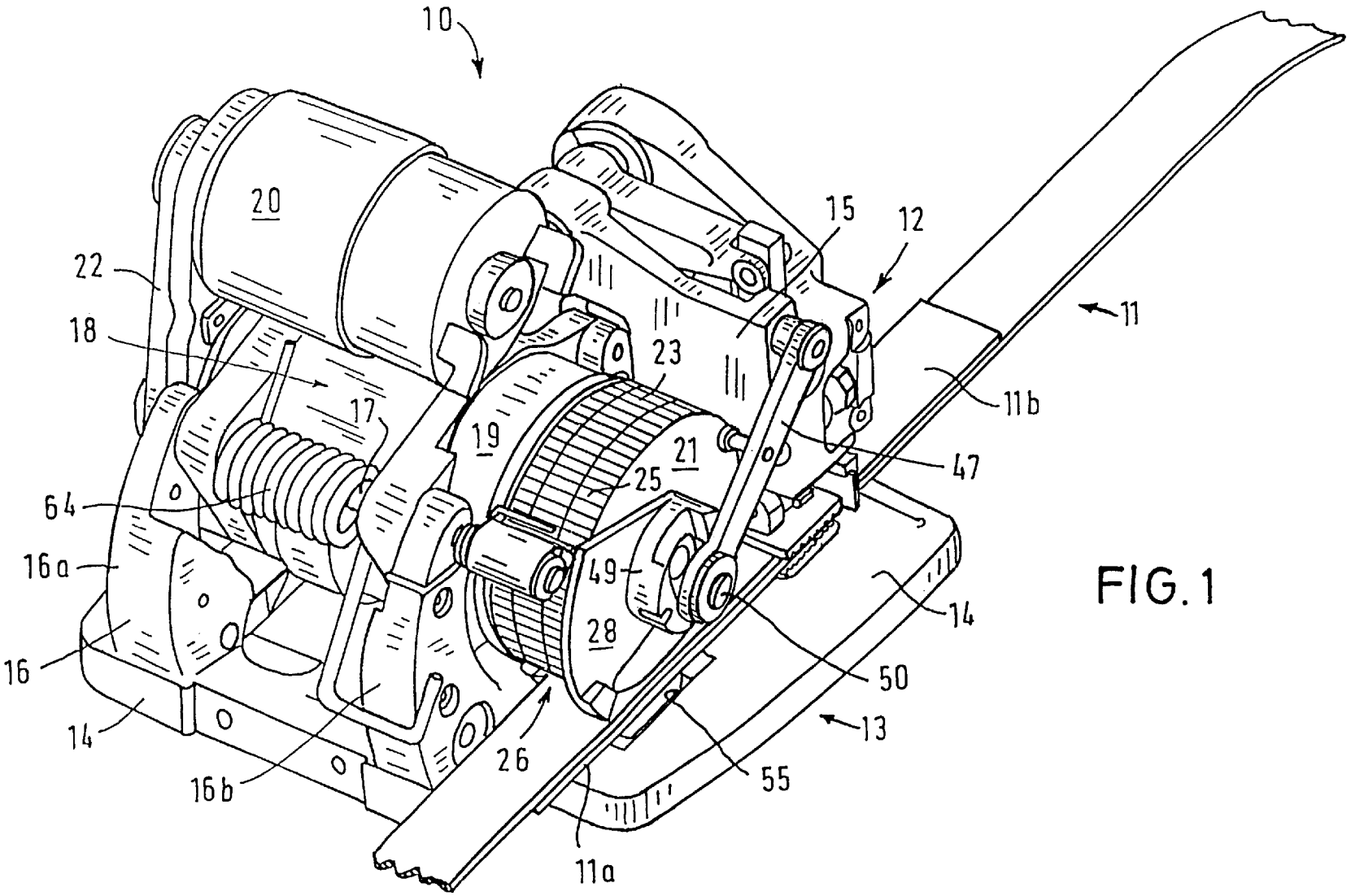
FIG. 1 is a front elevation view of a device according to the invention with a removed housing in a schematic perspective representation in the initial position with an inserted strapping band.

The tensioning device 10 depicted in the drawings serves for tightening a strapping band 11 of plastics, that is of stretched polyester which is placed about a package, not shown in detail, and the lower band end 11*a* and the upper band end 11*b* thereof immediately on top of one another are tightened by the tensioning device 10 and are then welded with a welding device 12 and cut off from the band supply. The welding device 12 is not the object of the invention and is therefore not illustrated and described in detail.

The tensioning device 10 has a base frame 13 with a base plate 14 having a centre wall 15 and a bearing block 16 vertically secured thereon or being moulded in one piece with the base plate 14. The two upright flanks 16*a* and 16*b* of the bearing block 16, arranged with a lateral distance from one another, carry a first stationary axis 17 at their upper free ends which is in front of the abutment in the tensioning direction 29 and on which a gearing block 18 is mounted in a pivotal manner. The gearing block 18 is surrounded by a gearing housing 19 on which is arranged a tensioning motor 20 which can operate in both rotary directions and which switches off in at least one rotary direction in dependence of the load.

The gearing 31 arranged in the inside of the gearing housing 19 is described below in further detail. In FIG. 1, it is connected on the right side of the tensioning device 10 to a tensioning wheel 21 which can be pivoted together with the gearing block 18 and the tensioning motor 20 secured thereon around the first stationary axis 17 and which can be driven by the tensioning motor 20 by means of a toothed belt 22 and the gearing 31 in both rotational directions. The tensioning wheel 21 has a profile 23 on its circumferential surface 25 and acts together with an abutment 24 in the base plate 14 which is embedded in the base plate 14 and also comprises a profile, not illustrated in detail. The profiled circumferential surface 25 of the tensioning wheel 21 forms, together with the abutment 24, a band channel 26 for the band ends 11*a* and 11*b*, which is open in the non-operational initial state of the device 10 on the right side of the device in FIG. 1, so that the band ends 11*a* and 11*b* can be inserted from the right side into the tensioning device 10 between the tensioning wheel 21 and the abutment 24. On the inside of the band channel 26 there is an inner band side guide 27 (FIGS. 2 and 3) which guides the band ends during the tightening at their left inner side edge in FIG. 1, while the outer right side edges of the band ends 11*a* and 11*b* in the device are guided by an outer band side guide element 28 which covers the band channel 26 on the outside during the tightening of the strapping band 11 and which will be described in detail below.

As has already been mentioned above, the upper band end 11*b* is drawn along the surface of the lower band end 11*a* and tightened by the tensioning wheel 21 in the tensioning direction 29, while the lower band end 11*a* is held by the surface profile or corrugation of the abutment 24. A rotational direction of the tensioning wheel in FIGS. 2 and 3 anti-clockwise corresponds to the tensioning direction 29, which rotational direction is also called "tensioning direction 29" in the following. A rotational direction or a pivotal direction of the tensioning wheel 21 clockwise is called "opposite direction" in short in the following and is designated with the reference numeral 30.

As has already been mentioned above, the tensioning wheel 21 can be driven by the motor 20 in both rotational directions 29 and 30. For this, the motor 20 is connected to the tensioning wheel 21 by means of a gearing 31 and transfers its drive torque to the main drive shaft 33 of the gearing 31 by means of the toothed belt 22 of the motor output disc 32, which shaft is positioned on the main drive shaft 34 of the gearing 31, is mounted rotationally in the gearing block 18 and carries a pinion toothing 35 at its inner end. The pinion toothing 35 is in engagement with two first planetary wheels 36 of a two-stage planetary gearing, of which only one is shown in FIG. 4 and which roll off in an inner toothing 37 of the gearing housing 19 and hereby rotate a planetary carrier 38 connected thereto.

The central pinion 39 of the second stage of the planetary gearing rotates with the planetary carrier 38 rigidly connected thereto, which drives three further planetary wheels which are mounted in the gearing housing 19 and which rotate the tensioning wheel 21, but of which only one 40 is shown. The tensioning wheel 21 is also mounted in the gearing housing 19, extends over the further planetary wheels 40 with a bowl connection and is in engagement with these by means of an inner toothing 42 of its bowl connection 41.

Figure 3:
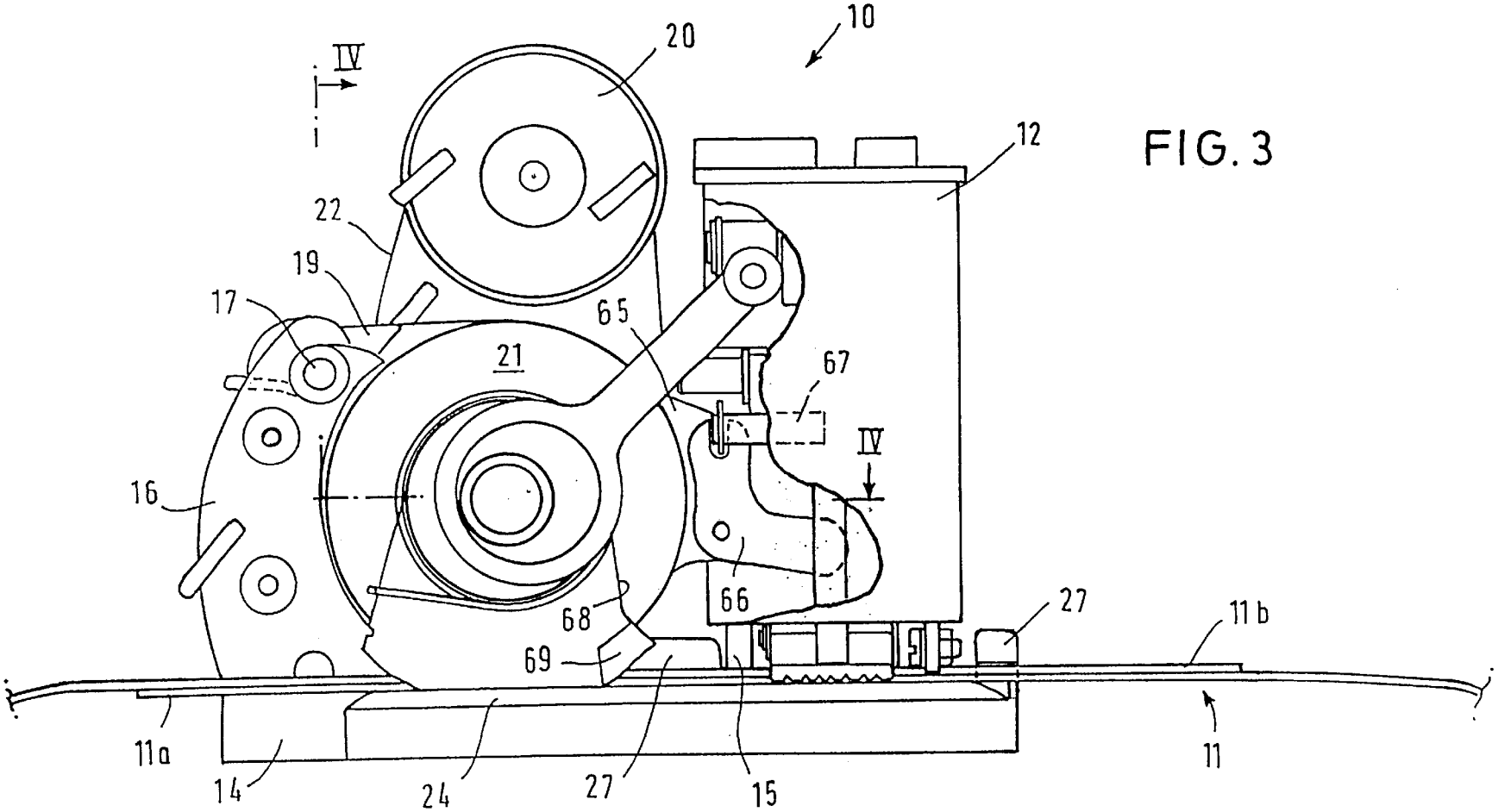
FIG. 3 is a side view of the tensioning device of FIG. 2 wherein the tensioning device is in its tensioning state; and, FIG. 4 is a cross-sectional view along line IV–IV of FIG. 3.
Figure 4:
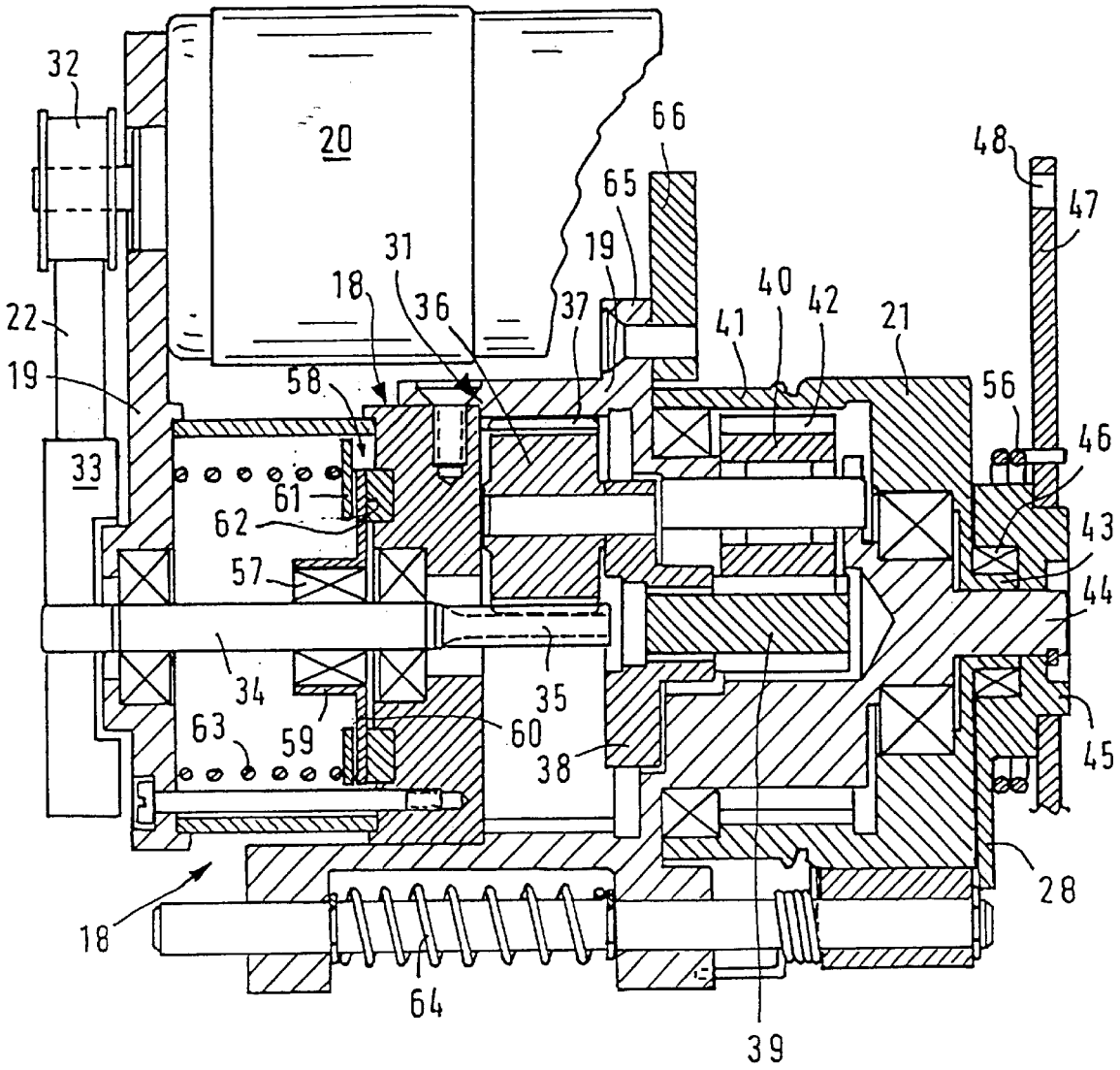

It can be seen from FIG. 4 that the tensioning wheel 21 comprises a hollow tensioning wheel swivel pin 43 on its outer front face, with which it is pushed onto an axis stub 44 of the gearing housing 19 and rotates thereon. An eccentric 45 with a freewheel is rotatably mounted on this tensioning wheel pin 43 in the tensioning direction 29, but non-rotatably in the opposite direction 30. The eccentric in turn is guided by a steering lever 47 which is mounted in a pivoted manner around a second stationary axis 48 which is arranged in a pivoted manner in the tensioning direction 29 on the right side of the abutment 24 at the centre wall 15 of the base frame 13. In FIG. 1 on the one hand, and in FIGS. 2 and 3 on the other hand, several possibilities of the connection between the steering lever and the eccentric are shown. With the embodiment according to FIG. 1, the eccentric has a base disc 49 which is concentric to the tensioning wheel 21, on which disc is arranged an eccentric pin 50 in an eccentric manner which can be rotated in a corresponding bore at the free end of the steering lever 47.

Figure 2:
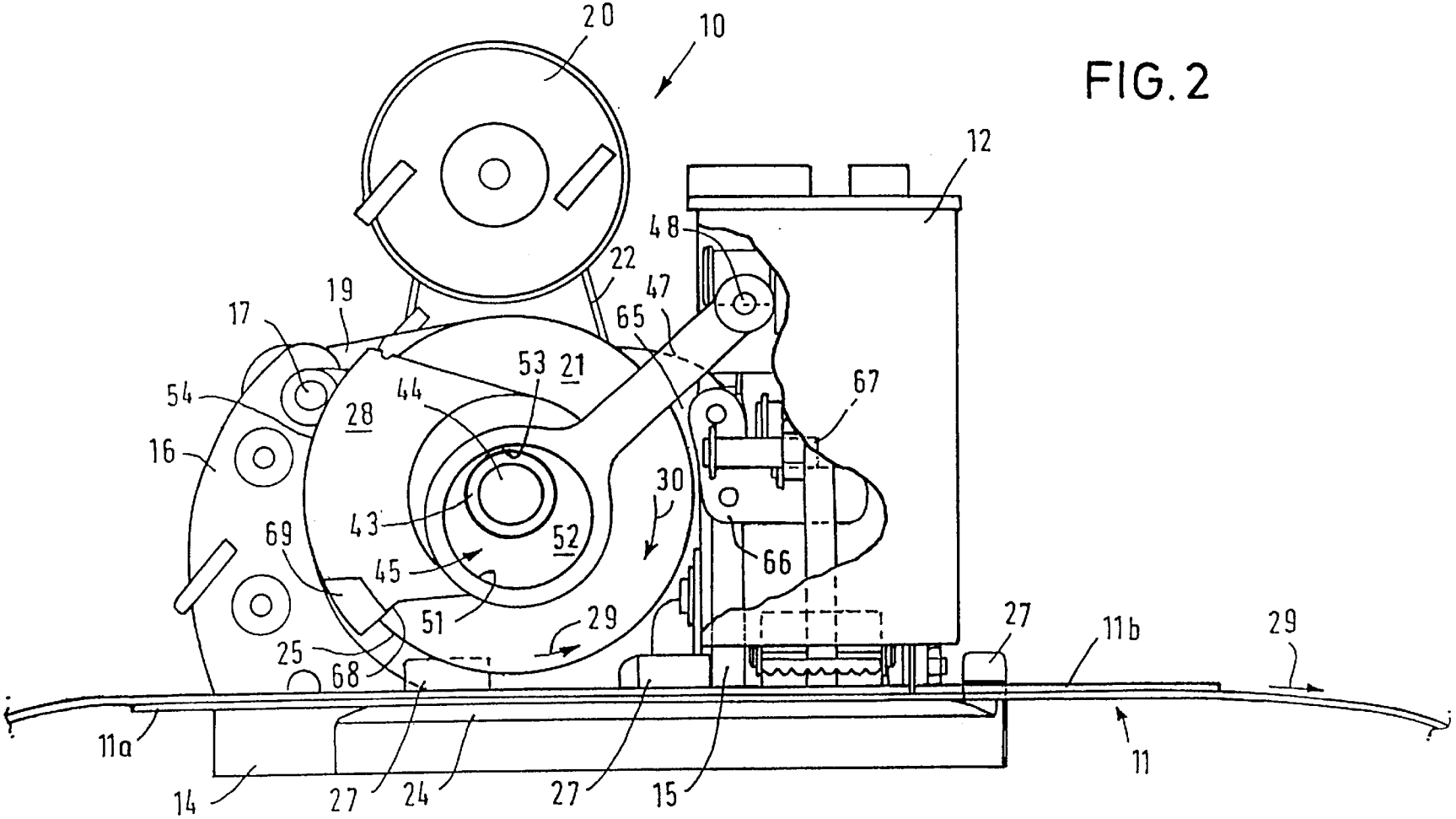
FIG. 2 is a side view of the tensioning device of FIG. 1.

In the embodiments shown in FIGS. 2 and 3, the steering lever 47 has a large circular eye 51 at its free end, in which a circular eccentric disc 52 can rotate which can be rotated with an eccentric bearing bore 53 on the tensioning wheel pin 43.

The mode of operation of both embodiments is essentially the same and will be described in detail below.

In both embodiments, the base disc 49 or the eccentric disc 52 carries the above-mentioned band side guide element 28 which conveniently consists of one piece with this disc and which is formed as a sector disc. The circular outer edge 54 of the band side guide element 28 projects from the circumferential surface 25 of the tensioning wheel and can enter a recess 55 of the base plate 14 of the base frame 13 if it rotates together with the eccentric 45 in the tightening direction 29 towards the abutment 13. So as to support this rotational movement, a first pressure element 56, that is, a torsion spring or a spiral spring is provided, which is strives to rotate the eccentric 45 in the tensioning direction 29 of the tensioning wheel 21. The band side guide element 28 has an inwardly guiding chamfer 69 at its front edge 68 in the tensioning direction 29, which chamfer pushes a band end 11*a* and 11*b*, which still projects outwardly, into the band channel 26 when the sector disc rotates towards the abutment.

It can be seen from FIG. 4 that a second freewheel 57 is provided in the drive shaft train 34,35, 39 of the gearing, that is, adjacent to one of the main bearings, in which the main drive shaft 34 can rotate freely when the tensioning wheel 21 is driven in the tensioning direction 29, but which blocks a reverse rotation of the drive shaft train 34, 35, 39 when the tensioning motor 20 stops after reaching the desired band tightening. In this state, the tightened upper band end 11*b* exerts a reversing momentum onto the tensioning wheel 21 in the opposite direction, and it has to be prevented that the tensioning wheel reverses and the band tightening is loosened hereby. This is achieved by the block of the second freewheel 57 and the brake 58.

So as to enable a reverse run of the tensioning motor 20 and to be able to also rotate the tensioning wheel 21 in the opposite direction 30 by means of the drive shaft train 34, 35, 39, the brake 58 is formed in such a manner that a reverse rotation of the blocked drive shaft train 34, 35, 39 is possible when the tensioning motor 20 reverses. This brake 58 at the second freewheel 57 consists of a brake disc 60 rigidly connected to the freewheel hub 59, which runs between friction elements 61 and 62 which are pressed together by spring elements 63.

From FIGS. 1 and 4 can be seen that the gearing block 18 with the tensioning wheel 21 is under the effect of a second pressure element 64, that is, a torsion spring, which strives, as a pivotal element, to pivot the gearing block 18 with the tensioning wheel 21 in the opposite direction 30 around the first stationary axis 17 against the stationary abutment 24. During this pivotal movement, the tensioning wheel 21 is guided at its tensioning wheel pin 43 with the help of the eccentric 45 and the steering lever 47, which form the guide means, whereby this pivotal movement is also supported by the first pressure element 56.

It can be seen from FIGS. 2 and 3 that a forwardly directed projection 66 is secured at an appendix 65 of the gearing housing 19, which projection pivots up and down around the first stationary axis 17 during a pivoting movement of the gearing block 18 and which abuts against a stop 67 at the centre wall 15 during the upward pivot of the tensioning wheel and limits the pivotal movement of the tensioning wheel into its non-effective initial position.

The mode of operation of the device is as follows:

In the initial position shown in FIG. 2 the band ends 11*a* and 11*b* of a strapping band 11 placed around a package are inserted and held on top of one another from the right-side in FIG. 1 of the device 10 into the band channel 26 up to the inner band side guide 27. Afterwards, the tensioning motor 20 is switched on in the forward run by means of a push button, not described in detail. The main drive disc 33 driven by the motor output disc 32 by means of the tooth belt 22 then rotates the main drive shaft 34 which is not hindered by the freewheel 57 during this forward run.

The planetary wheels 36 are driven by means of the pinion toothing 35, which wheels roll off on the inner toothing 37 of the gearing housing 19 and rotate a planetary carrier 38 hereby. The central pinion 39 connected rigidly to the planetary carrier 38 also rotates hereby and drives the planetary wheels 40, which in turn rotate the tensioning wheel 21 at its inner toothing 42 in the tensioning direction 29.

When the tensioning wheel 21 starts rotating in the tensioning direction 29, the eccentric 45 is freed from its stoppage and follows the tensioning wheel 21 in the tensioning direction 29 due to its bearing friction and under the pressure of the first pressure element 56. The eccentric rotates hereby in the embodiment depicted in FIGS. 2 and 3 in the bearing bore 53 of the steering lever 47 from the initial position shown in FIG. 2 into the operating position illustrated in FIG. 3, whereby the steering lever 47 pivots the tensioning wheel 21 in the opposite direction 30 around a first stationary axis 17 down to the abutment 24 to such an extent until the tensioning wheel with its profiled circumferential surface 25 sits on the upper band end 11*b*.

During the rotation of the eccentric 45 the outer band side guide element 28 which is rigidly connected thereto pivots down in the tensioning direction and at the same time covers the band channel 26 at its outer side, so that the band ends 11*a* and 11*b* are guided in the band channel 26 at both side edges during tightening.

It can be seen that the pivotal movement of the gearing block 18 initiated by the rotation of the tensioning wheel 21 in the tensioning direction 29 is supported by the second pressure element 64 which presses the tensioning wheel 21 firmly against the band ends 11*a* and 11*b* and against the abutment 24. The profiled circumferential surface 25 of the tensioning wheel digs hereby into the surface of the upper band end 11*b*, climbs along this initially a little in the opposite direction 30 until the friction between the tensioning wheel 21 and the upper band end 11*b* increases by the increasing pressing pressure so much that it overshoots the friction between the two band ends 11*a* and 11*b*. The rotating tensioning wheel 21 then draws the upper band end 11*b* in the tensioning direction over the lower band end 11*a*, which is hereby held by the profiled surface of the abutment 24.

As soon as the band tightening has reached the desired previously determined value, the tensioning motor 20 switches itself off. The reversing momentum produced by the draw of the band in the tensioning wheel 21, which translates to the gearing 31 through the drive shaft train 34, 35, 39 activates the catch in the second freewheel 57, whereby a reverse rotation of the tensioning wheel 21 is prevented due to the action of the brake 58.

The band ends 11*a* and 11*b* can now be welded in the in the welding device 12 in an essentially known manner and can be cut. Afterwards, the tensioning motor 20 is switched into reverse gear with the push button, and now drives the main drive shaft 34 in reverse by means of the main drive disc 33. As this rotational direction is blocked by the second freewheel 57, the action of the brake 58 has to be overcome hereby. The drive force of the motor 20 has such a magnitude that this is possible. During the reverse run the tensioning wheel 21 is now rotated in the opposite direction 30 by the gearing 31. As the first freewheel 46 also blocks in this rotational direction, the eccentric 45 is taken along with the backwardly rotating tensioning wheel pin 43 and also rotates backwards in the bearing bore 53 of the steering lever 47 in the opposite direction 30 back again into the initial position shown in FIG. 2. During this rotational movement, the gearing block 18 is pivoted upwards by the steering lever 47 against the action of the second pressure element 64 until the projection 66 abuts the stop 67. The tensioning wheel 21 is then held in the initial position illustrated in FIG. 2 by the detent torque of the tensioning motor 20 and/or by the stoppages in the gearing 31 and in the eccentric 45 formed by the freewheels 46 and 57. In this position, the tensioning device 10 can be drawn off laterally from the closed strapping.

The invention is not restricted to the illustrated and the described embodiment, but several changes and additions are possible without leaving the scope of the invention. For example, a pawl catch or a suitable brake can be used as stoppage instead of a freewheel. Furthermore, it is possible to use other pressure elements as pivoting means such as pneumatic pressure accumulators or elastomer blocks. Finally it is also possible to use an air motor instead of an electric motor and to control the motor together with the welding and cutting device according to an electronic program.

What is claimed is:

1. A device for tightening strapping bands including an abutment and with a tensioning wheel provided with a return stop driven by a tensioning motor by means of gearing, said tensioning wheel forms a tensioning channel with said abutment to tighten ends of said band, said tensioning wheel arranged in a gearing block with said tensioning motor and the gearing, said tensioning wheel, said gearing block and said tensioning motor pivotally mounted around a first stationary axis in a base frame of the device, said tensioning wheel held by holding means mounted with friction on a tensioning wheel pin, said tensioning wheel in its ineffective position is lifted from one of said band ends and is pivoted against said abutment under the action of a pressure element when said tensioning wheel starts in the tensioning direction and said holding means loses its effective position, characterised in that said tensioning wheel can be driven by said tensioning motor in the tensioning direction and in the opposite direction and that a return stop is a freewheel with a brake which blocks the reverse rotation of said tensioning wheel when said tensioning motor stops, but allows a reverse rotation of said tensioning wheel when said tensioning motor reverses, and said tensioning wheel mounted rotatably on a tensioning wheel pin in an eccentric with friction, which in turn is guided rotatably in a steering lever which is pivotally mounted on a second stationary axis on said base frame and that another freewheel is arranged against said tensioning direction between said tensioning wheel pin and said eccentric.

2. The device as defined in claim 1, wherein said band ends are immediately on top of one another in said tensioning channel, whereby a lower band end is held in a non-positive manner by the surface of said abutment, while an upper band end is drawn along on a surface of the lower band end by a circumferential surface of said tensioning wheel provided with a profile.

3. The device as defined in claim 1, wherein said first stationary axis of said gearing block and said second stationary axis of said steering lever are arranged on different sides of said abutment.

4. The device as defined in claim 2, wherein said first stationary axis of said gearing block and said second stationary axis of said steering lever are arranged on different sides of said abutment.

5. The device as defined in claim 1, wherein said first stationary axis of said gearing block is arranged in said tensioning direction in front of said abutment and said second stationary axis of said steering lever is arranged behind said abutment.

6. The device as defined in claim 4, wherein said first stationary axis of said gearing block is arranged in said tensioning direction in front of said abutment and said second stationary axis of said steering lever is arranged behind said abutment.

7. The device as defined in claim 1, wherein said tensioning wheel is guided by said eccentric and said steering lever in such a manner that said tensioning wheel is pivoted against said abutment during a rotation of said tensioning wheel in said tensioning direction in the opposite direction and is lifted from said abutment during a rotation of said tensioning wheel in the opposite direction.

8. The device as defined in claim 6, wherein said tensioning wheel is guided by said eccentric and said steering lever in such a manner that said tensioning wheel is pivoted against said abutment during a rotation of said tensioning wheel in said tensioning direction in the opposite direction and is lifted from said abutment during a rotation of said tensioning wheel in the opposite direction.

9. The device as defined in claim 1, wherein said eccentric is under the action of a first pressure element which strives to rotate said eccentric in said tensioning direction of said tensioning wheel.

10. The device as defined in claim 8, wherein said eccentric is under the action of a first pressure element which strives to rotate said eccentric in said tensioning direction of said tensioning wheel.

11. The device as defined in claim 1, wherein said freewheel and said brake are arranged in a drive shaft train of a gearing for said tensioning wheel.

12. The device as defined in claim 10, wherein said freewheel and said brake are arranged in a drive shaft train of a gearing for said tensioning wheel.

13. The device as defined in claim 1, wherein said brake at said second freewheel is a brake disc connected to a freewheel hub, which disc runs between rigid friction elements pressed together by spring elements.

14. The device as defined in claim 12, wherein said brake at said second freewheel is a brake disc connected to a freewheel hub, which disc runs between rigid friction elements pressed together by spring elements.

15. The device as defined in claim 1, wherein said tensioning wheel is held in the ineffective position lifted from the band ends by a detent torque of said tensioning motor and/or by a block in said another freewheel of said eccentric and/or by a block in said freewheel of the gearing.

16. The device as defined in claim 15, wherein said tensioning wheel is held in the ineffective position lifted from the band ends by a detent torque of said tensioning motor and/or by a block in said another freewheel of said eccentric and/or by a block in said freewheel of the gearing.

17. The device as defined in claim 1, wherein said eccentric is arranged on a band side guide element rotatable around said tensioning wheel pin which element is under the action of a first pressure element which rotates a band side guide element in said tensioning direction to the extent that it covers tensioning channel laterally when said tensioning wheel is in its tensioning position pivoted down on said abutment.

18. The device as defined in claim 16, wherein said eccentric is arranged on a band side guide element rotatable around said tensioning wheel pin which element is under the action of a first pressure element which rotates a band side guide element in said tensioning direction to the extent that it covers tensioning channel laterally when said tensioning wheel is in its tensioning position pivoted down on said abutment.

19. The device as defined in claim 17, wherein said band side guide element is a sector disc which comprises a chamfer guided inwardly at a front edge in said tensioning direction.

20. The device as defined in claim 18, wherein said band side guide element is a sector disc which comprises a chamfer guided inwardly at a front edge in said tensioning direction.

* * * * *